US007665247B1

(12) United States Patent
Pratt

(10) Patent No.: US 7,665,247 B1
(45) Date of Patent: Feb. 23, 2010

(54) GUTTER DEBRIS DEFLECTOR HAVING MULTIPLE SLOTS

(76) Inventor: James M. Pratt, P.O. Box 920624, Needham, MA (US) 02492-0007

( * ) Notice: Subject to any disclaimer, the term of this patent is extended or adjusted under 35 U.S.C. 154(b) by 26 days.

(21) Appl. No.: 11/973,675

(22) Filed: Oct. 11, 2007

Related U.S. Application Data

(63) Continuation-in-part of application No. 11/478,134, filed on Jun. 30, 2006, now abandoned, which is a continuation-in-part of application No. 11/323,874, filed on Jan. 3, 2006, now abandoned.

(51) Int. Cl.
*E04D 13/00* (2006.01)

(52) U.S. Cl. ..... 52/12; 52/11; 210/474

(58) Field of Classification Search ..... 52/11, 52/12; 4/510; D23/267; 210/154, 474
See application file for complete search history.

(56) References Cited

U.S. PATENT DOCUMENTS 2,583,422 A * 1/1952 Haddon ..... 210/498
5,216,852 A * 6/1993 Bemis et al. ..... 52/12
5,251,410 A * 10/1993 Carey ..... 52/12
5,406,756 A * 4/1995 Bemis et al. ..... 52/16
5,555,680 A * 9/1996 Sweers ..... 52/12
D395,713 S * 6/1998 Schrotenboer ..... D25/152
5,842,311 A * 12/1998 Morin ..... 52/12
6,067,755 A * 5/2000 Maanum ..... 52/12
6,904,718 B2 * 6/2005 Fox ..... 52/12

FOREIGN PATENT DOCUMENTS

JP 05209450 A * 8/1993

* cited by examiner

*Primary Examiner*—Robert J Canfield
*Assistant Examiner*—Christine T Cajilig
(74) *Attorney, Agent, or Firm*—William Nitkin

(57) ABSTRACT

A gutter debris deflector for preventing debris, such as pine needles, access to a rain gutter attached to a residential home, such gutter debris deflector having an upper portion that is attached to the roof boards of the home and a lower portion that has an upper and a lower set of angular slots forming a plurality of angular rib members therebetween with a spacer portion therebetween, such deflector extending across the gutter to prevent debris from entering therein.

2 Claims, 3 Drawing Sheets

GUTTER DEBRIS DEFLECTOR HAVING MULTIPLE SLOTS

This application is a continuation-in-part of my prior application entitled Gutter Debris Deflector Having Multiple Slots, Ser. No. 11/478,134, filed Jun. 30, 2006, now abandoned, which was a continuation-in-part of my prior application entitled Gutter Debris Deflector filed Jan. 3, 2006, Ser. No. 11/323,874, now abandoned.

BACKGROUND OF THE INVENTION

1. Field of the Invention

The present invention resides in the field of rain gutters and more particularly relates to a cover member for a rain gutter for preventing debris, such as pine needles, leaves and other debris, from entering the rain gutter by directing such debris to flow over the rain gutter while still allowing rainwater to flow into the rain gutter.

2. History of the Prior Art

Rain gutters are found on houses, particularly roofs, and are used for the removal of water. During the course of removing water, rain gutters frequently become clogged with leaves and other debris which block the flow of water through the gutters.

Problems associated with clogged rain gutters are inhibited water drainage, breakage of the gutter system due to increased load to gutters from the weight of the collected debris, and expensive repairs to house and gutters. Overflow water from a backed up gutter system can freeze in the winter, resulting in water damage to the home and structural damage to the gutter braces and surrounding house surfaces.

Olson in U.S. Pat. No. 3,295,264 has addressed the above described problems by utilizing a screen for collecting debris. The weakness of this invention lies in its inherent collection method. As a collector of pine needles and other debris, the screen becomes covered with debris which needs to be manually cleared periodically.

Another proposed solution is a solid deflector-type unit instead of a screen collector-type device. A solid deflector also exhibits inherent problems such as allowing leaves, pine needles and other debris to resist following the contours of the deflector system. This problem is related to water surface tension. Thus leaves and other debris are allowed to block the gutter system while water is not sufficiently directed into the gutter system. Further, lighter debris, such as pine needles, become caught in the surface tension of the water, thereby becoming trapped in the gutter. These designs also require a system of additional clips, as taught by U.S. Pat. Nos. 4,604,837 to Beam and 6,735,907 to Stevens.

SUMMARY OF THE INVENTION

It is an object of the present invention to prevent pine needles and other debris from entering rain gutters while still allowing rainwater to be directed into the gutters, thereby avoiding the problems associated with blocked rain gutters.

It is a further object of this invention to provide a unitary, one-piece, plastic gutter debris deflector that is economical to manufacture, substantially maintenance free and allows a rain gutter to become less clogged by debris during rainfall compared to other prior art systems. The present invention allows pine needles and other debris to be separated from the rainwater and to be carried off separately from the rainwater. Since pine needles are thin and short in length and difficult to direct, the angled rib members in the deflector of this invention assist in their passage as they move over the angled rib members. The angled rib members work to reduce the surface tension of the water, thereby providing for freer movement of pine needles over the deflector. The slots of this invention between the rib members are only open to a piece of debris moving in a direction perpendicular to the plane of the gutter for a short distance until the debris passes over such slot toward the next slot so that while water will pass into a slot easily, debris cannot and it will more easily pass over the gutter deflector and fall to the ground.

It is a still further object of the gutter debris deflector of this invention to be easily retrofitted to a variety of roof and gutter types and be able to be used with many different materials as well as to be aesthetically pleasing to the eye when installed.

DESCRIPTION OF THE PREFERRED EMBODIMENT(S)

Figure 1:
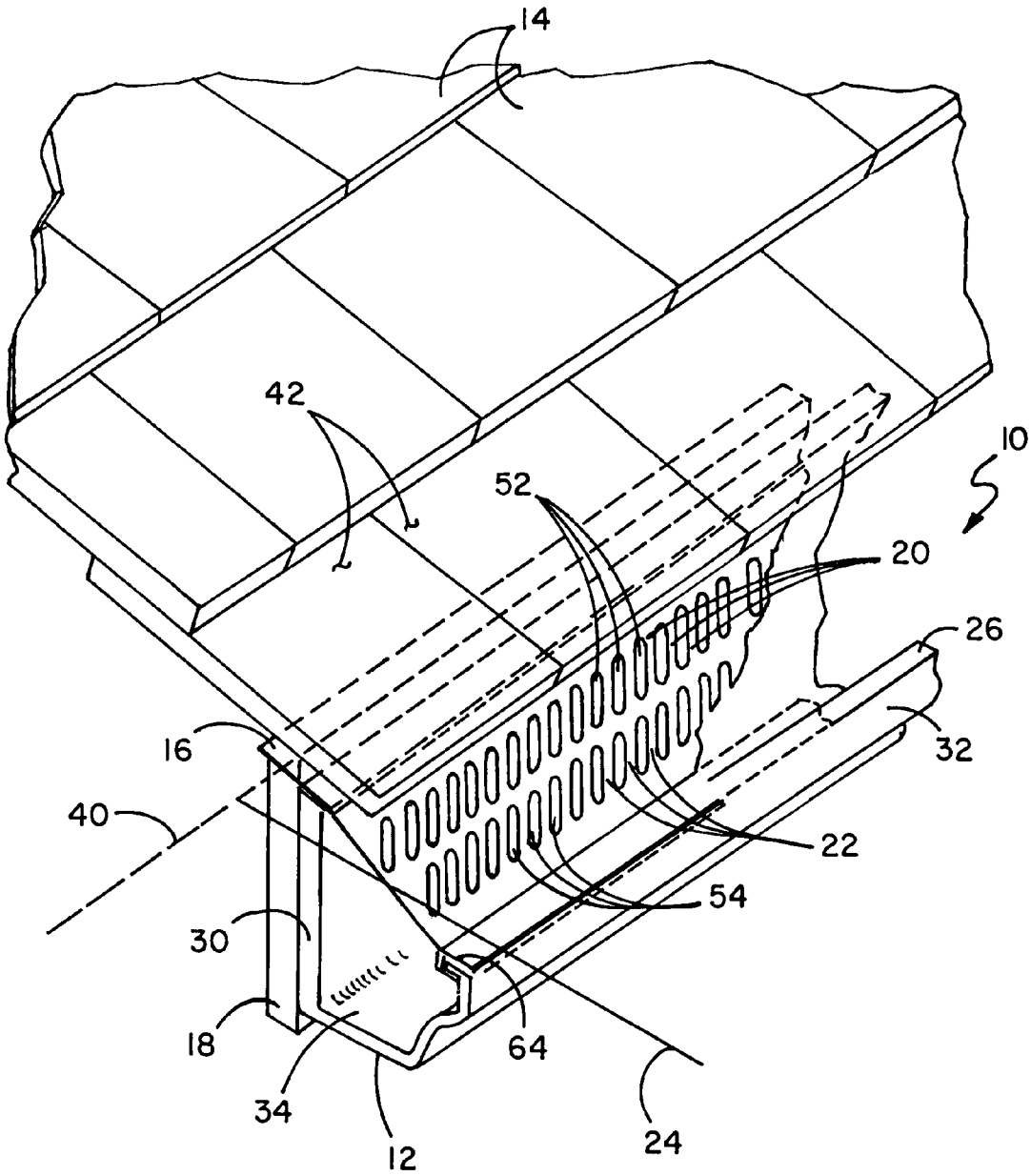
FIG. 1 illustrates a front perspective view of the Gutter Debris Deflector of this invention mounted on a gutter with parts of the deflector having a portion cut away.
Figure 2:
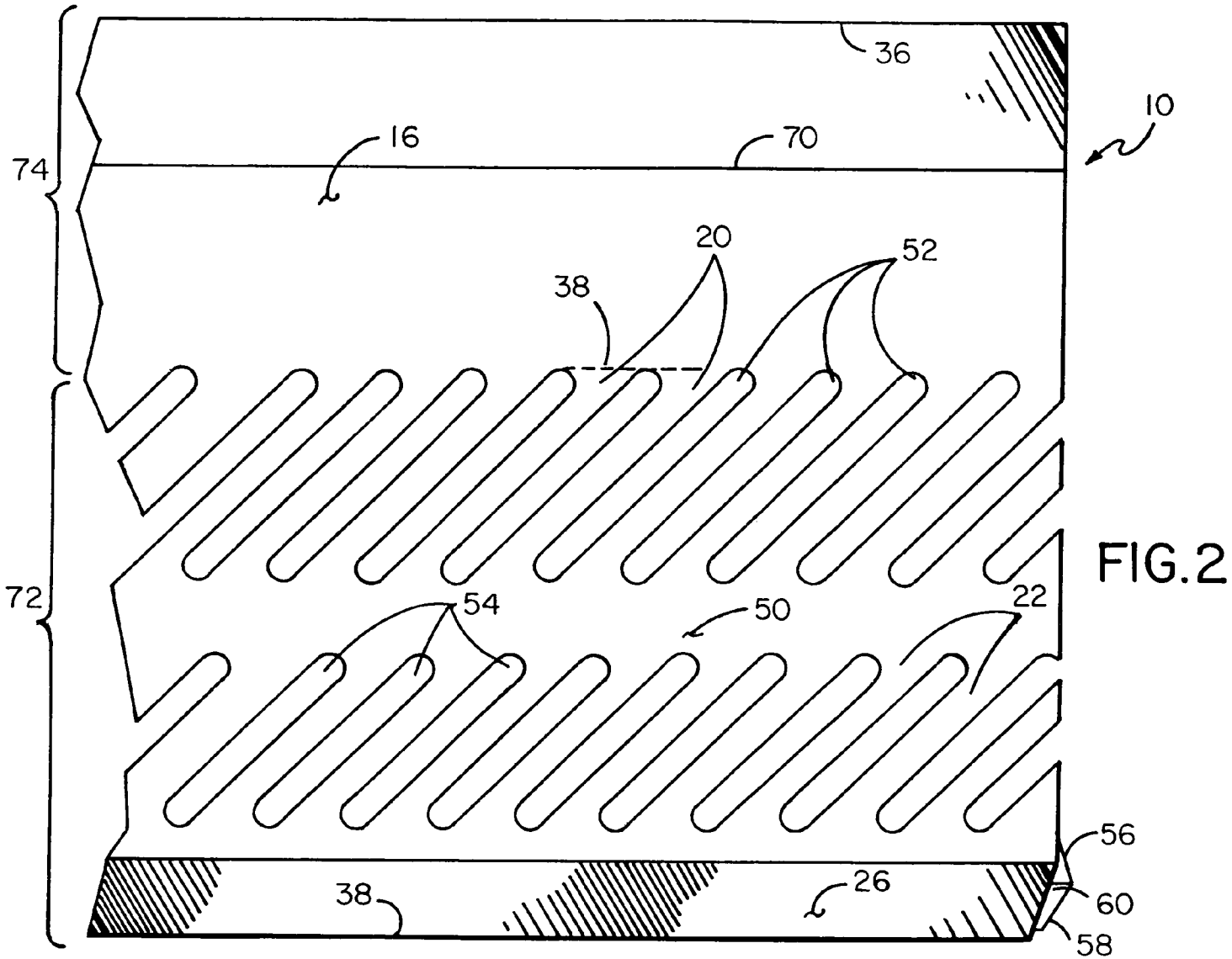
FIG. 2 illustrates a top plan view of the Gutter Debris Deflector of FIG. 1.
Figure 3:
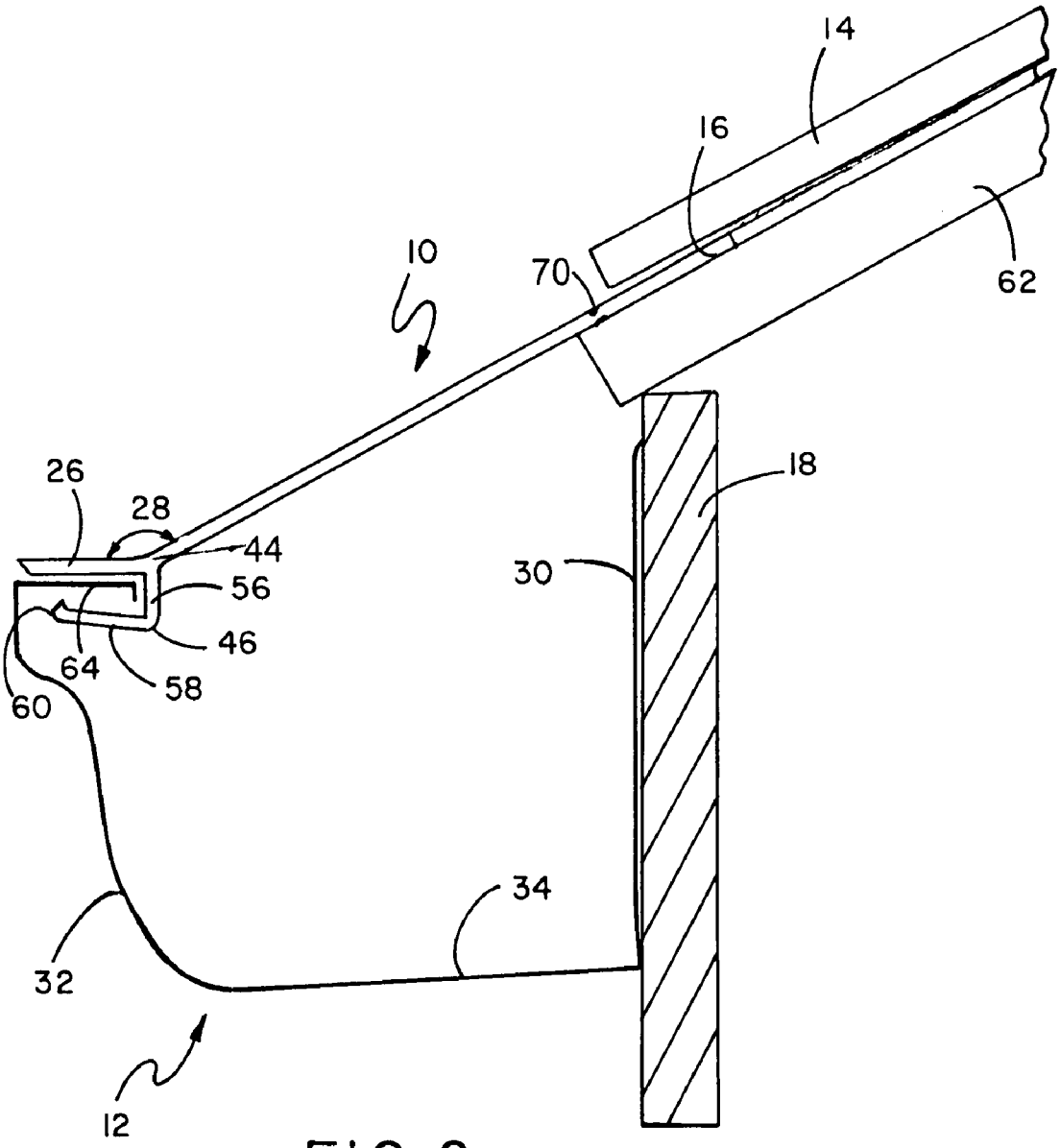
FIG. 3 illustrates a cross-sectional side view of the Gutter Debris Deflector in place showing its gutter lip attachment.

FIG. 1 illustrates a front perspective view of the Gutter Debris Deflector 10 of this invention mounted on a roof having roof shingles 14. Fascia board 18, and gutter 12 mounted thereon, extend in a roof plane 40 along the side of the roof. Gutter extension plane 24 is perpendicular to roof plane 40. Gutter 12 has inner side 30 attached to fascia board 18 and outer side edge 32, defining water collection area 34 therebetween, all of which gutter structure is well known in the prior art. Deflector 10 of this invention can be cut from a substantially planar, one-piece, unitary piece of material such as thin plastic or rubber-like sheet material or equivalent and is formed with an upper portion 74 and a lower portion 72, as seen in FIG. 2. Upper portion 74 consists of roof attachment member 16 that extends the length of the deflector which roof attachment member 16 has a width that is approximately 2½-3 inches with a first elongated side 36 opposite second elongated side 38, defining its width, as seen in FIG. 2. Score line 70 runs along deflector 10 approximately 1½ inches from first elongated side 36 and is parallel thereto to allow for easy bending of deflector 10 at score line 70. Deflector 10, when installed along roof plane 40, as seen in FIG. 1, extends parallel to the length of the gutter and the side of the roof on which the gutter is installed. As seen in FIG. 1, roof attachment member 16 is installed under the first layer of shingles 42 by lifting such shingles and nailing or otherwise affixing roof attachment member 16 to roofing boards 62, as seen in FIG. 3, which roofing boards are also well known in the prior art. Roof attachment member 16, being made of a thin sheet of material, such as plastic and the like, does not significantly displace the first layer of shingles 42, as best seen in FIG. 3. The lower portion 72 of deflector 10 extends to second elongated side 38 and can extend at a downward angle, as seen in FIGS. 1 and 3, from score line 70. A plurality of lower slots 54 are defined in lower portion 72, such slots disposed at approximately a 45 degree angle to roof plane 40 and to the length of gutter 12, such slots forming therebetween a plurality of parallel upper rib members 20. Upper rib members 20 have defined, respectively therebetween, a plurality of upper slots 52 which are disposed parallel to and between such upper rib members. Each upper rib member 20 is approximately ½ inch wide, and upper slots 52 are approximately ¼ inch wide and approximately 2¼ inches in length. These dimensions are critical to preventing debris from falling in the gutter. Each upper rib member 20 extends a distance to spacer portion 50 which is approximately ½ inch wide. On the other side of spacer portion 50 is a plurality of lower slots 54 which are substantially parallel to one another and in some cases may align with upper slots 52. Between lower slots 54 are defined a plurality of lower rib members 22, such lower slots 54 and lower rib members 22 also being disposed at approximately a 45 degree angle to roof plane 40 and to the length of gutter 12. Deflector 10 extends to rest upon, and engage, top lip 64 of outer side edge 32 of gutter 12, as best seen in FIG. 3. Upper and lower rib members in some embodiments may not align with one another. The lower rib members 22 are each approximately ½ inch wide, and the plurality of lower slots 54 are each approximately ¼ inch wide and 2¼ inches in length. These dimensions are again critical to preventing debris from falling in the gutter.

Joining the outer ends of lower rib members 22 is edge portion 26, as seen in FIG. 2, which extends upwards at a slight angle 28, as seen in FIG. 3, and is approximately ¾ inch wide. Water and debris coming down from the roof pass onto the rib members, but the angular open upper slots 52 and lower slots 54 allow only water to pass easily therethrough while the debris is substantially carried over the upper and lower ribs of the deflector to fall off edge member 26 of the deflector without a significant amount of debris passing into water collection area 34. The gutter debris deflector of this invention can be economically made by the process of extrusion and the upper and lower slots can be die cut therein. Deflector 10 can be provided in elongated 8 foot strips to be cut to the desired length on-site as it is being installed.

Seen in FIG. 3 is edge member 26 which extends upward at a slight angle 28 from the angle of the surface of deflector 10. Deflector 10 has a rear engagement member 56 extending downward from the junction 44 of edge member 26 with the rest of deflector 10. At the base 46 of rear engagement member 56 extending substantially parallel to edge member 26 is engagement member bottom 58 which terminates in an upwardly extending bottom lip 60. In use, edge member 26 along with its rear engagement member 56 and bottom engagement member 58, surround and engage inwardly extending gutter lip 64 so as to better hold deflector 10 to gutter lip 64 on the outer portion of gutter 12.

The positioning of the slots at substantially a 45 degree angle to the plane of roof 40 aids in the prevention of debris falling into the gutter. As debris is moving over the gutter in a direction generally perpendicular to the plane of roof 40, such debris only passes over the angular slots for a short distance before passing onto the portions of the gutter deflector ribs between such slots so that the debris will more easily reach and pass over edge member 26 while at the same time water will easily pass into the slots.

Although the present invention has been described with reference to particular embodiments, it will be apparent to those skilled in the art that variations and modifications can be substituted therefor without departing from the principles and spirit of the invention.

I claim:

1. A gutter debris deflector for covering an open gutter which is joined to a roof which has an identifiable roof plane axis and is covered by roof shingles, wherein the open gutter is installed along the side of the roof in a plane parallel to the roof plane axis and includes an inner side attached to a fascia board of the roof, an extended outer side edge, and a water collection area therebetween, said gutter debris deflector comprising:

an elongated and substantially planar deflector member having a discernible upper portion, a discernible lower portion, and discrete gutter edge engagement means joined together as a unitary article wherein, said upper portion of said deflector member is a roof attachment sheet which is suitable for attachment on-demand to a layer of roof shingles covering the roof and which will then be positioned on the roof in a plane parallel to the roof plane axis along the side of the roof on which the gutter is installed, said upper portion of said deflector member being a thin sheet which (1) is fashioned of a solid material without perforations, (2) has a width dimension which allows for its attachment to the roof under a layer of roof shingles covering the roof, (3) has discrete first and second sheet ends between which the length dimension for said deflector member is determined, and said lower portion of said deflector member is a debris separator sheet which is unified with said upper portion along its length dimension and is able to separate debris from rain water after said upper portion is attached to the roof, said lower portion of said deflector member being a sheet of material which (i) is capable of being bent into conformity with a plane which is parallel to the roof plane axis, (ii) presents a first plurality of discrete ¼ inch wide open slots and ½ inch wide separator ribs approximately 2¼ inches in length arranged in continuing sequential series, each said open slot in said first sequential series being disposed in parallel on said debris separator sheet at an angle of approximately 45 degrees with respect to the roof plane axis, and each said open slot being separated from the next open slot in sequential series by a discrete separating rib formed of solid matter which is also disposed on said debris separator sheet at an angle of approximately 45 degrees with respect to the roof plane axis, (iii) presents a second plurality of discrete ¼ inch wide open slots and ½ inch wide separator ribs approximately 2¼ inches in length arranged in continuing sequential series, each said open slot in said second sequential series being disposed in parallel on said debris separator sheet at an angle of approximately 45 degrees with respect to the roof plane axis, and each said open slot being separated from the next open slot in sequential series by a discrete separating rib formed of solid matter which is also disposed on said debris separator sheet at an angle of approximately 45 degrees with respect to the roof plane axis, (iv) a spacer portion of solid matter disposed between said first plurality of slots and ribs in sequential series and said second plurality of slots and ribs in sequential series, and said gutter edge engagement means of said deflector member are unified with said lower portion along its length dimension, are intended for at will attachment to the extended outer side edge of the open gutter installed along the side of the roof, and serve to deflect and carry off debris away from the water collection area of the installed gutter, said gutter edge engagement means of said deflector member including:

(a) an edge strip portion of solid matter which has a width of approximately ¾ of an inch, has a length dimension coextensive with that of said upper and lower portions, and extends outwardly at a slight upward angle with respect to the positioning of said lower portion of said deflector member, (b) an edge engagement base having a bottom, which edge engagement base extends downwardly from said edge strip portion, and is suitable for engaging a part of the extended outer side edge of the open gutter installed along the side of the roof, and (c) a bottom engagement end which extends from said bottom of said edge engagement base and is disposed substantially parallel to said edge strip portion, and is suitable for engaging another part of the extended outer side edge of the open gutter installed along the side of the roof.

2. The gutter debris deflector of claim 1 further including:

a bottom lip disposed on said bottom engagement end and extending upward therefrom to aid in engaging said extended outer side edge of said open gutter.

* * * * *